US007503960B2

(12) United States Patent
Plunkett et al.

(10) Patent No.: US 7,503,960 B2
(45) **Date of Patent: *Mar. 17, 2009**

(54) SMOKING ARTICLES AND FILTERS WITH CARBON FIBER COMPOSITE MOLECULAR SIEVE SORBENT

(75) Inventors: Susan E. Plunkett, Richmond, VA (US); Kenneth H. Shafer, Sutherland, VA (US)

(73) Assignee: Philip Morris USA Inc., Richmond, VA (US)

( * ) Notice: Subject to any disclaimer, the term of this patent is extended or adjusted under 35 U.S.C. 154(b) by 429 days.

This patent is subject to a terminal disclaimer.

(21) Appl. No.: 11/079,857

(22) Filed: Mar. 15, 2005

(65) Prior Publication Data

US 2006/0207620 A1 Sep. 21, 2006

(51) Int. Cl.
*A24D 3/16* (2006.01)
*B01D 53/04* (2006.01)

(52) U.S. Cl. ..... 95/141; 95/903; 96/134; 493/50; 131/202; 131/331

(58) Field of Classification Search ..... 95/90, 95/141, 903; 96/108, 134; 55/385.1; 493/39, 493/50; 131/331, 341, 342, 202
See application file for complete search history.

(56) References Cited

U.S. PATENT DOCUMENTS

| | | | | |
|---|---|---|---|---|
| 2,881,770 | A | | 4/1959 | Touey |
| 3,101,723 | A | | 8/1963 | Seligman et al. |
| 3,353,543 | A | | 11/1967 | Sproull et al. |
| 3,958,579 | A | | 5/1976 | Baker |
| 4,219,031 | A | | 8/1980 | Rainer et al. |
| 4,379,465 | A | | 4/1983 | Coq |
| 4,412,937 | A | | 11/1983 | Ikegami et al. |
| 4,516,589 | A | * | 5/1985 | Rainer et al. ..... 131/331 |
| 4,700,723 | A | | 10/1987 | Yoshikawa et al. |
| 4,753,717 | A | | 6/1988 | Yata et al. |
| 4,772,508 | A | | 9/1988 | Brassell |
| 4,774,972 | A | | 10/1988 | Hayes |
| 4,820,681 | A | | 4/1989 | Chang et al. |
| 4,917,835 | A | | 4/1990 | Lear et al. |
| 4,933,314 | A | | 6/1990 | Marumo et al. |

(Continued)

FOREIGN PATENT DOCUMENTS

EP 0 532 329 A2 3/1983

(Continued)

OTHER PUBLICATIONS

1. T. D. Burchell et al., "A Novel Process and Material for the Separation of Carbon Dioxide and Hydrogen Sulfide Gas Mixtures", Carbon vol. 35, No. 9, pp. 1279-1294, 1997.

(Continued)

*Primary Examiner*—Frank M Lawrence
(74) *Attorney, Agent, or Firm*—Buchanan Ingersoll & Rooney PC

(57) ABSTRACT

Filters and smoking articles include at least one carbon fiber composite molecular sieve sorbent capable of selectively removing one or more selected constituents from mainstream smoke. Methods for making cigarette filters and smoking articles using the carbon fiber composite molecular sieve sorbent and methods for treating mainstream tobacco smoke in a cigarette comprising the carbon fiber composite molecular sieve sorbent are also provided.

30 Claims, 10 Drawing Sheets

U.S. PATENT DOCUMENTS

| | | | | |
|---|---|---|---|---|
| 4,966,171 | A | | 10/1990 | Serrano et al. |
| 5,059,578 | A | | 10/1991 | Marumo et al. |
| 5,191,905 | A | | 3/1993 | Tsukamoto |
| 5,322,075 | A | | 6/1994 | Deevi et al. |
| 5,360,023 | A | | 11/1994 | Blakley et al. |
| 5,389,325 | A | | 2/1995 | Bookbinder et al. |
| 5,409,021 | A | | 4/1995 | Safaev et al. |
| 5,435,326 | A | | 7/1995 | Gentry et al. |
| 5,486,410 | A | | 1/1996 | Groeger et al. |
| 5,499,636 | A | | 3/1996 | Baggett, Jr. et al. |
| 5,510,063 | A | | 4/1996 | Gadkaree et al. |
| 5,543,096 | A | | 8/1996 | Wu |
| 5,568,819 | A | | 10/1996 | Gentry et al. |
| 5,591,368 | A | | 1/1997 | Fleischhauer et al. |
| 5,632,286 | A | | 5/1997 | Berger et al. |
| 5,666,976 | A | | 9/1997 | Adams et al. |
| 5,685,986 | A | | 11/1997 | Yamada et al. |
| 5,692,525 | A | | 12/1997 | Counts et al. |
| 5,692,526 | A | | 12/1997 | Adams et al. |
| 5,732,718 | A | | 3/1998 | Douglas et al. |
| 5,744,075 | A | | 4/1998 | Klett et al. |
| 5,744,421 | A | | 4/1998 | Robinson et al. |
| 5,820,967 | A | | 10/1998 | Gadkaree |
| 5,827,355 | A | | 10/1998 | Wilson et al. |
| 5,846,639 | A | | 12/1998 | Robinson et al. |
| 5,911,224 | A | * | 6/1999 | Berger ..... 131/332 |
| 5,914,294 | A | | 6/1999 | Park et al. |
| 5,915,387 | A | | 6/1999 | Baggett, Jr. et al. |
| 5,934,289 | A | | 8/1999 | Watkins et al. |
| 5,972,253 | A | | 10/1999 | Kimber |
| 5,988,176 | A | | 11/1999 | Baggett, Jr. et al. |
| 6,026,820 | A | | 2/2000 | Baggett, Jr. et al. |
| 6,030,698 | A | | 2/2000 | Burchell et al. |
| 6,053,176 | A | | 4/2000 | Adams et al. |
| 6,090,477 | A | | 7/2000 | Burchell et al. |
| 6,206,007 | B1 | | 3/2001 | Yoshida et al. |
| 6,207,264 | B1 | | 3/2001 | Robinson et al. |
| 6,214,204 | B1 | | 4/2001 | Gadkaree et al. |
| 6,257,242 | B1 | | 7/2001 | Stavridis |
| 6,258,300 | B1 | | 7/2001 | Burchell et al. |
| 6,475,411 | B1 | | 11/2002 | Burchell et al. |
| 6,814,786 | B1 | * | 11/2004 | Zhuang et al. ..... 96/131 |
| 2006/0231113 | A1 | * | 10/2006 | Newbery et al. ..... 131/334 |

FOREIGN PATENT DOCUMENTS

| | | | | |
|---|---|---|---|---|
| FR | 1446250 | A | * | 7/1966 |
| GB | 1023918 | A | | 3/1966 |
| GB | 1553357 | A | | 9/1979 |
| WO | 03/086116 | A | | 10/2003 |

OTHER PUBLICATIONS

2. L. B. McCusker et al., "Nomenclature of Structural and Compositional Characteristics of Ordered Microporous and Mesoporous Materials with Inorganic Hosts", Pure Applied Chemistry, vol. 73, No. 2, pp. 381-394, 2001.
3. Timothy D. Burchell et al., "Passive $Co_2$ Removal Using a Carbon Fiber Composite Molecular Sieve", Energy Conversion Management, vol. 37, Nos. 6-8, pp. 947-954, 1996.
4. Tim Burchell et al., Capturing Carbon the ORNL Way, Oak Ridge National Laboratory Review, vol. 33, No. 2, pp. 1-3., 2000, http://www.ornl.gov/ORNLReview/v33_2_00/capturing.htm.
5. Rod Judkins et al., "A Novel Gas Separation Material and Process", http://ccs.ornl.gov/3M/judkins2.html, May 4, 1998.
6. Burchell et al., "Neat Fibers", M&C researchers' new carbon molecule sieve and voltage "swing" technologies draw interest of the natural gas industry, http://www.ornl.gov/publications/labnotes/april96/sieve.htm, no date given.
7. T.D. Burchell et al., Proceedings of 23rd Biennial Conference on Carbon, American Carbon Society, p. 158 (1997).
International Search Report and Written Opinion dated Jul. 31, 2006 for PCT/IB2006/001128.
International Preliminary Report on Patentability dated Sep. 18, 2007 for PCT/IB2006/001128.

* cited by examiner

SLURRY MOLDING FLOW CHART

SMOKING ARTICLES AND FILTERS WITH CARBON FIBER COMPOSITE MOLECULAR SIEVE SORBENT

BACKGROUND

A variety of filter materials have been suggested for incorporation into cigarette filters. Cigarettes incorporating filter elements with adsorbent materials have been described. Forms of carbon, such as carbon fibers and granular carbon, have been described for use in cigarettes.

SUMMARY

Filters, smoking articles and methods for treating mainstream tobacco smoke are provided. A preferred embodiment of the filters comprises a sorbent including a carbon fiber composite molecular sieve sorbent, which can selectively remove at least one selected constituent from mainstream tobacco smoke. In embodiments, the sorbent can be incorporated in a cigarette filter having various constructions and that can include other materials. The sorbent can be incorporated into one or more parts of the cigarette filter.

In another preferred embodiment, a smoking article comprises a carbon fiber composite molecular sieve sorbent. The smoking article can be, for example, a cigarette, pipe, cigar or non-traditional cigarette.

A preferred embodiment of a method of making a cigarette filter comprises incorporating a carbon fiber composite molecular sieve sorbent into a filter.

A preferred embodiment of a method of making a cigarette comprises placing a paper wrapper around a tobacco column to form a tobacco rod, and attaching a cigarette filter to the tobacco rod to form the cigarette, wherein the cigarette filter includes a carbon fiber composite molecular sieve sorbent.

A preferred embodiment of a method of treating mainstream tobacco smoke comprises heating or lighting tobacco in the cigarette to form smoke, and drawing the smoke through a filter of the cigarette. A carbon fiber composite molecular sieve sorbent in the filter removes one or more selected constituents from mainstream smoke by contact with the smoke.

BRIEF DESCRIPTION OF THE DRAWING FIGURES

DETAILED DESCRIPTION OF PREFERRED EMBODIMENTS

Figure 1:
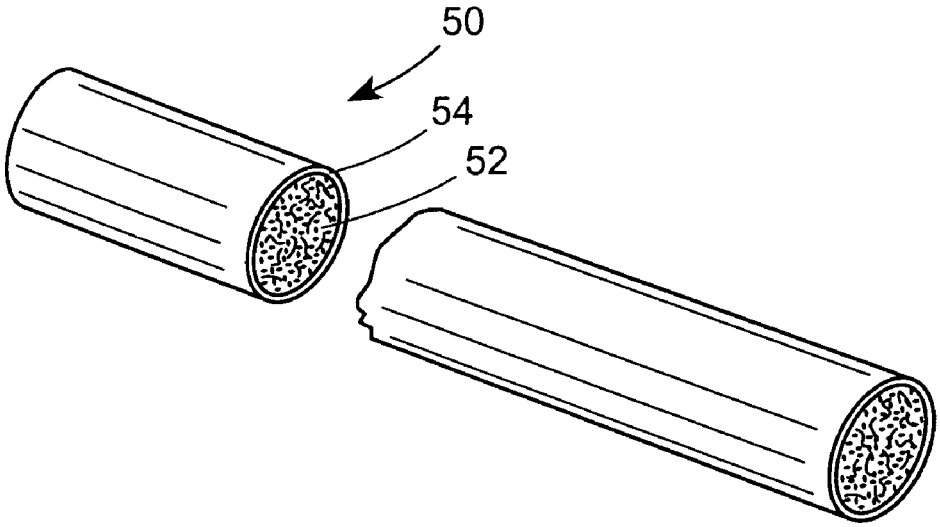
FIG. 1 illustrates a preferred embodiment of a filter element including a carbon fiber composite molecular sieve sorbent.

Filters and smoking articles are provided that include a sorbent capable of selectively removing one or more selected constituents from mainstream smoke. Methods of making the filters and smoking articles, as well as methods of treating mainstream tobacco smoke during smoking of cigarettes including the sorbent are also provided.

As used herein, the term "sorption" includes filtration by adsorption and/or absorption. Sorption encompasses interactions on the outer surface of the sorbent, as well as interactions within the pores and channels of the sorbent. In other words, a "sorbent" is a substance that can condense or hold molecules of other substances on its surface, and/or can take up other substances, i.e., through penetration of the other substances into its inner structure, or into its pores. Accordingly, the term "sorbent" as used herein refers to an adsorbent, an absorbent, or a substance that can function as both an adsorbent and an absorbent.

The term "mainstream" smoke includes the mixture of gases, solid particles and aerosol that passes down the tobacco rod and issues through the filter end, i.e., the smoke that issues or is drawn from the mouth end of a smoking article during smoking of the smoking article. Mainstream smoke contains air that is drawn in through both the lit region of the smoking article and through the paper wrapper.

The term "molecular sieve" as used herein refers to a porous structure comprising an organic material, an inorganic material, or a mixture thereof. Molecular sieves include natural and synthetic zeolites, mesoporous silicates, alumino phosphates, and other related porous materials, such as mixed oxide gels, which may optionally further comprise inorganic or organic ions, and/or metals.

The carbon fiber composite molecular sieve sorbent can be microporous, mesoporous, and/or macroporous. The term "microporous molecular sieves" generally refers to such materials with pore sizes of about 2 nm (20 Å) or less. The term "mesoporous molecular sieves" generally refers to such materials with pore sizes of about 2-50 nm (20-500 Å). See, for example, *Pure Appl. Chem.*, Vol. 73, No. 2, pp. 381-394 (2001). Materials with pore sizes of about 500 Å or larger may be referred to as "macroporous." Microporous, mesoporous, and/or macroporous molecular sieve sorbents can be chosen based on the selected constituent(s) that is/are desired to be removed from a gas stream, such as from mainstream smoke. If desired, the carbon fiber composite molecular sieve sorbent can be used in combination with one or more different molecular sieves in a filter and/or smoking article.

The smoking articles in which the sorbent can be incorporated can include, but are not limited to, cigarettes, pipes and cigars, as well as non-traditional cigarettes. Non-traditional cigarettes include, for example, smoking articles that include combustible heat sources, as the smoking article described in commonly-assigned U.S. Pat. No. 4,966,171, and cigarettes for electrical smoking systems, such as the smoking articles described in commonly-assigned U.S. Pat. Nos. 6,026,820; 5,988,176; 5,915,387; 5,692,526; 5,692,525; 5,666,976 and 5,499,636, each of which is incorporated herein by reference in its entirety.

In preferred embodiments, the sorbent incorporated into a cigarette filter or smoking article comprises a carbon fiber composite molecular sieve sorbent. The carbon fiber composite molecular sieve sorbent is a porous body including carbon fibers. The carbon fibers are activated carbon fibers, which are bonded to each other, such as at points of contact between the individual carbon fibers. In preferred embodiments, the carbon fiber composite molecular sieve sorbent is a porous monolithic body.

FIG. 1 illustrates a preferred embodiment of a filter element 50 including a carbon fiber composite molecular sieve sorbent 52 in the form of a rigid porous body. The carbon fiber composite molecular sieve sorbent is not limited to any particular configuration. For example, it can have a cylindrical shape, such as shown in FIG. 1, as well as various other shapes that may include oval or polygonal cross sectional shapes, sheet-like, spherical, honeycomb, or other monolithic shapes, and the like. An optional outer protective coating material 54 further enhances the structural rigidity of the carbon fiber composite molecular sieve sorbent for handling purposes.

The carbon fiber composite molecular sieve sorbent can have different sizes. For example, when used in a cigarette filter, the carbon fiber composite molecular sieve sorbent preferably is cylindrical, and preferably has a length less than about 20 mm and a diameter slightly less than the diameter of the filter portion of the cigarette. For example, the diameter of the carbon fiber composite molecular sieve sorbent can be slightly less than about 8 mm, which is a typical diameter of a traditional cigarette. In other embodiments in which the carbon fiber composite molecular sieve sorbent is used in a smoking article other than a cigarette, the carbon fiber composite molecular sieve sorbent can have different dimensions appropriate for such smoking article. For example, when used in a cigar, the carbon fiber composite molecular sieve sorbent preferably has a width or diameter slightly less than the width or diameter of the cigar.

In a preferred embodiment, the carbon fiber composite molecular sieve sorbent is oriented in the smoking article to extend lengthwise along the length dimension of the smoking article. Such orientation of the sorbent increases the length of the flow path through the carbon fiber composite molecular sieve sorbent traveled by mainstream tobacco smoke, thus exposing the smoke to an increased surface area of the carbon fibers. Accordingly, the removal of selected constituents from the mainstream tobacco smoke by the carbon fiber composite molecular sieve sorbent can be increased by orienting the sorbent in this manner.

Increasing the length of the carbon fiber composite molecular sieve sorbent also increases the pressure drop along its length to achieve a given gas flow rate through the carbon fiber composite molecular sieve sorbent. As increasing the pressure drop increases the resistance to draw (RTD) of the smoking article, in preferred embodiments, the length of the carbon fiber composite molecular sieve sorbent is less than about 20 mm to provide a desirable balance between the length of the gas flow path and the RTD of the smoking article.

Figure 2:
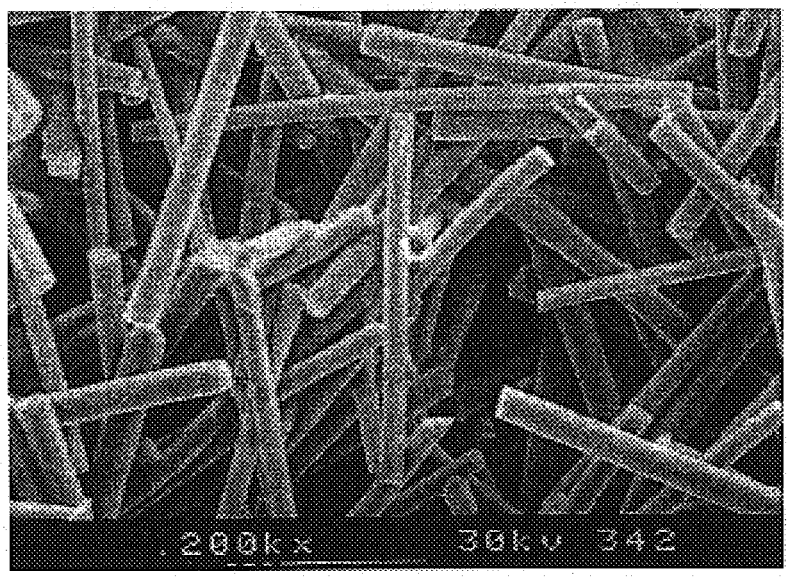
FIG. 2 is a scanning electron microscope (SEM) image at 200× of an embodiment of a carbon fiber composite molecular sieve sorbent, showing interbonded carbon fibers.

The carbon fiber composite molecular sieve sorbent preferably comprises activated carbon fibers interbonded by carbon in a gas-permeable structure. FIG. 2 is a scanning electron microscope (SEM) image of the carbon fiber composite molecular sieve sorbent, showing interbonded carbon fibers, and voids between carbon fibers. Gas can readily flow through the voids and access carbon fiber surfaces. The structure of the carbon fiber composite molecular sieve sorbent immobilizes the carbon fibers while also providing a suitable gas permeability.

Figure 3:
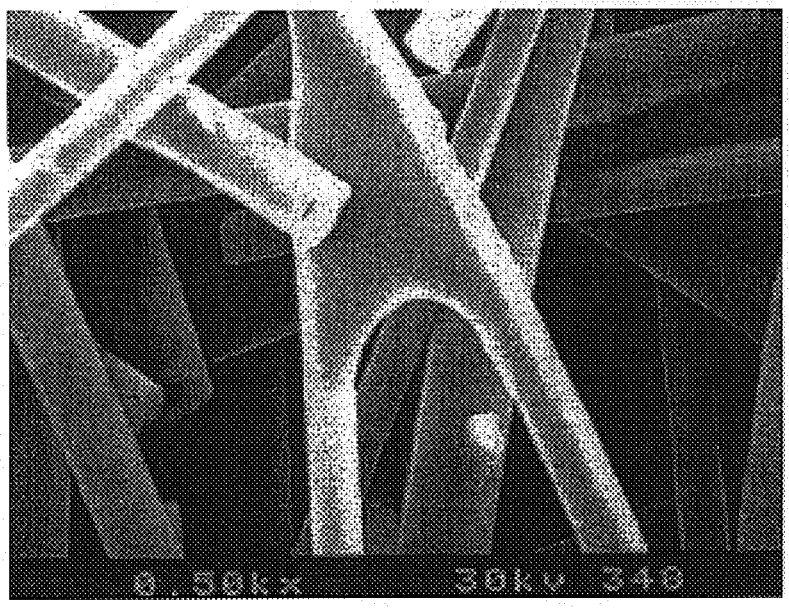
FIG. 3 is an SEM image at 500× showing a junction at which several carbon fibers of a carbon fiber composite molecular sieve sorbent are interbonded.

FIG. 3 is an SEM image showing a typical junction at which several carbon fibers are interbonded. The junction is preferably formed by carbon that remains after carbonizing a resin material used to interbond the carbon fibers at the junction, as described in greater detail below.

Figure 4:
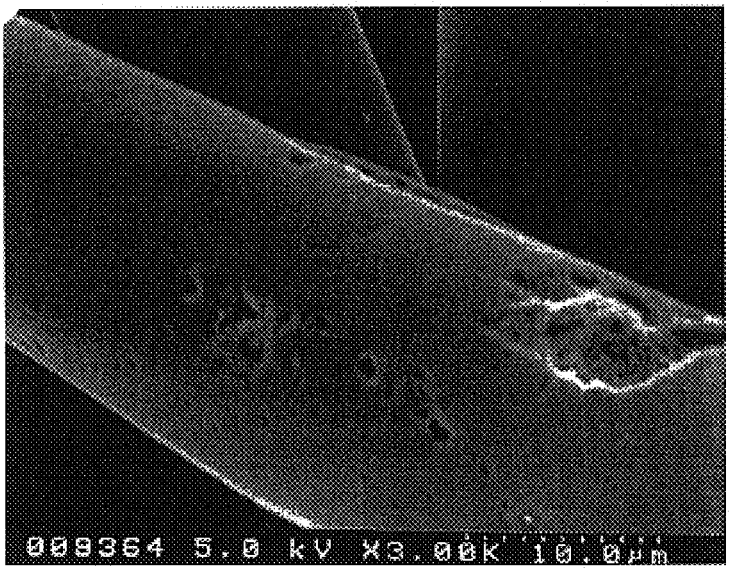
FIG. 4 is an SEM image at 5000× showing the porous surface of an individual carbon fiber of a carbon fiber composite molecular sieve sorbent.

FIG. 4 is an SEM image showing the surface of an individual activated carbon fiber. The surface includes pores formed during activation of the fiber, as described below. The pores have dimensions effective to sorb one or more selected gaseous constituents of mainstream tobacco smoke.

Figure 5:
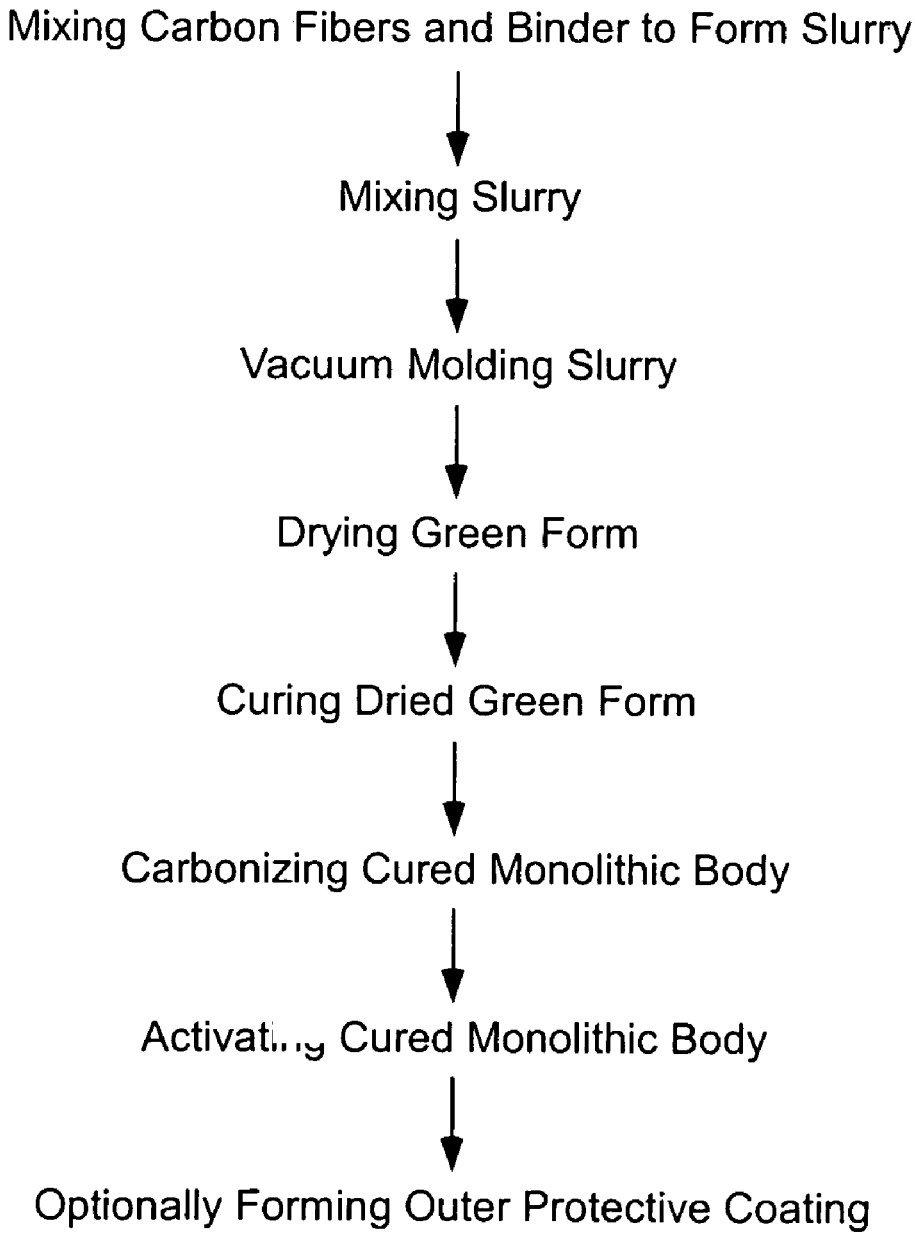
FIG. 5 is a flowchart showing steps of an embodiment of a method of manufacturing a carbon fiber composite molecular sieve sorbent.

FIG. 5 shows the steps of an exemplary embodiment of the methods of manufacturing a carbon fiber composite molecular sieve sorbent. The method is a slurry molding process. The method includes mixing carbon fibers with a binder to form a slurry. The slurry can be a water slurry, or alternatively a non-aqueous slurry. Water preferably is used to form the slurry because it can be readily removed from the slurry by subsequent processing. For example, carbon fibers and binder particles can be formed into a slurry, and the slurry can then be dried and heated in an oxidizing atmosphere to carbonize the resin and activate the carbon fibers.

The carbon fibers are preferably isotropic fibers derived from a suitable isotropic pitch precursor. The manufacture of such carbon fibers is described, for example, in U.S. Pat. No. 6,030,698, which is incorporated herein by reference in its entirety. However, other types of carbon fibers can alternatively be used. For example, such other carbon fibers can be derived from coal tar pitch, rayon, or heavy oils. Suitable carbon fibers are commercially available from Ashland Petroleum Company, located in Ashland, Ky., and from Anshan East Asia Carbon Company, located in Anshan, China.

In a preferred embodiment, the carbon fibers have a diameter of from about 10 microns to about 25 microns, and a length of from about 100 microns to about 1000 microns, more preferably from about 100 microns to about 500 microns.

In a preferred embodiment of the methods, the binder is an organic material that can be carbonized by being heated to a sufficiently high temperature. For example, the binder can be pitch, thermosetting resin or phenolic resin. Preferably, the binder is phenolic resin, which is water-soluble and provides a suitably high carbon yield when carbonized. The phenolic resin is preferably in powder form.

In the embodiment, the water slurry containing the carbon fibers and binder is mixed to provide a uniform mixture. The slurry is then formed into a shaped body having the configuration that is desired for the carbon fiber composite molecular sieve sorbent. In a preferred embodiment, slurry is formed into a shaped body by a vacuum molding process, such as the process described in U.S. Pat. No. 6,030,698. In the vacuum molding process, slurry is transferred to a holding vessel, and liquid (e.g., water) is drawn through a porous mold under vacuum pressure to produce a green form. In other embodiments, a different forming process can be used.

In the embodiment, after vacuum molding, the green form is dried. In a preferred embodiment, the drying temperature is from about 50° C. to about 60° C. The dried form is removed from the mold and cured to cross-link the binder. The curing temperature is selected based on factors including the binder composition. For example, for a phenolic resin binder, the form is cured in an air or other suitable atmosphere at a preferred temperature of from about 130° C. to about 150° C. The cured carbon fiber composite has a monolithic structure.

In the embodiment, the cured carbon fiber composite is then carbonized. In this step, the cured carbon fiber composite is heated at a selected temperature, and for an effective amount of time, to sufficiently carbonize the binder. For example, the carbon fiber composite can be heated at a temperature of about 600° C. to about 700° C. in an inert gas atmosphere to carbonize phenolic resin.

After carbonization, the carbon fiber composite is activated to develop pores in the carbon fibers, as shown in FIG. 4. The activation step utilizes an oxygen-containing atmosphere, such as steam, carbon dioxide or oxygen. These gases react with the carbon fibers, causing carbon to be removed from the fibers to form the pores. Oxygen also chemically activates the carbon fiber surface to enhance gas filtration selectivity based on chemisorption, i.e., the formation of a covalent bond.

In a preferred embodiment, the carbon fiber composite is activated to a desired burn-off, which represents the weight loss (i.e., weight loss=initial weight−final weight) of the carbon fiber composite. As the level of burn-off is increased, the carbon fiber surface area increases. For example, the BET (Brunauer, Emmett, and Teller) surface area of an embodiment of the carbon fiber composite molecular sieve sorbent was determined to increase from about 800 $m^2/g$ for a burn-off of about 10% to about 2100 $m^2/g$ for a burn-off of about 50%. In a preferred embodiment, the BET surface area of the carbon fiber composite molecular sieve sorbent is from about 1000 $m^2/g$ to about 2,500 $m^2/g$.

Figure 6:
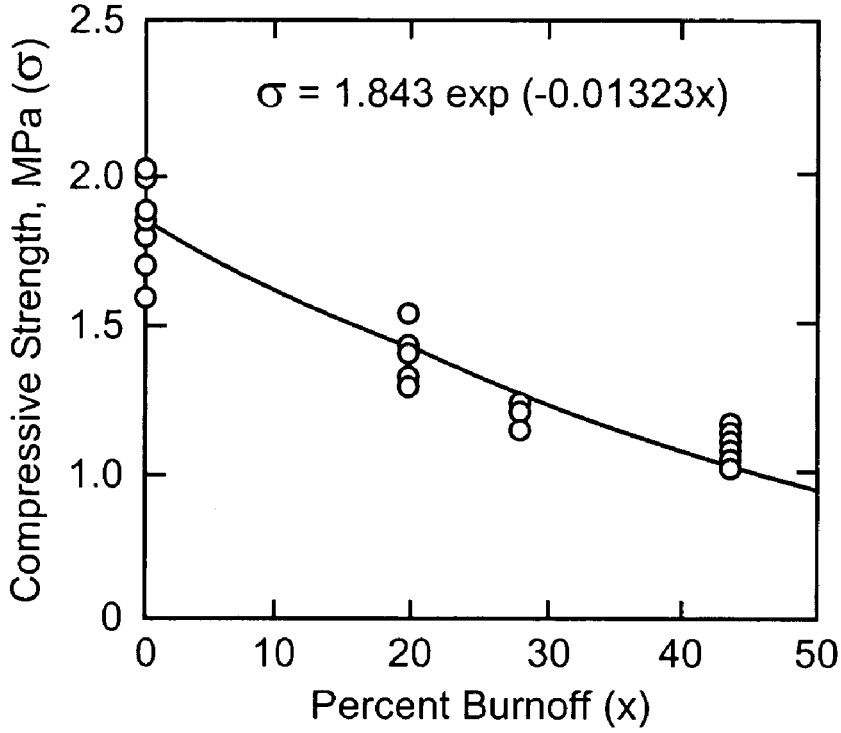
FIG. 6 shows the relationship between compressive strength and % burn-off during activation for an embodiment of the carbon fiber composite molecular sieve sorbent.

FIG. 6 provides results showing that increasing the burn-off also reduces the compressive strength of the carbon fiber composite molecular sieve sorbent due to the increased loss of carbon from the carbon fibers. In preferred embodiments, the burn-off is controlled to achieve a carbon fiber composite molecular sieve sorbent having a desirable combination of carbon fiber surface area and compressive strength.

Burn-off can also be controlled to control the pore size, pore volume and density of the carbon fiber composite molecular sieve sorbent. For example, the activation atmosphere and temperature can be varied to control the pore structure. In one embodiment, the Dubinin-Redushkevich (D-R) micropore volume of the carbon fiber composite molecular sieve sorbent was increased from about 0.35 $cm^3/g$ for a burn-off of about 10% to about 0.75 $cm^3/g$ for a burn-off of about 50%, and the D-R micropore size was increased from about 1.55 nm for a burn-off of about 10% to about 2.5 nm for a burn-off of about 50%. In a preferred embodiment, the D-R micropore volume of the carbon fiber composite molecular sieve sorbent can be from about 0.1 $cm^3/g$ to about 1 $cm^3/g$. In a preferred embodiment, the activated carbon fiber molecular sieve sorbent has a density of from about 0.15 $g/cm^3$ to about 0.25 $g/cm^3$.

As described above, the carbon fiber composite molecular sieve sorbent can include an outer protective material to enhance its rigidity. The outer protective material reduces the possibility of fragmentation of the carbon fiber composite molecular sieve sorbent when it is incorporated into a smoking article. As a result, the carbon fiber composite molecular sieve sorbent can retain its structure during manufacture, transportation and use of the smoking article. In a preferred embodiment, the outer protective material is a hard carbon material, such as graphite, which enhances the rigidity of the composite structure and is electrically conductive. In addition, the outer protective material is inert, i.e., it preferably will not oxidize, burn or off-gas in the cigarette.

In an embodiment, the outer protective material comprises a hollow sleeve sized to tightly enclose the carbon fiber composite molecular sieve sorbent. The carbon fiber composite molecular sieve sorbent can be inserted into the sleeve. In another embodiment, the outer protective material can be applied as a coating on the carbon fiber composite molecular sieve sorbent by any suitable technique, such as by a spraying or immersion technique.

In preferred embodiments, the pores of the carbon fiber composite molecular sieve sorbent are larger than the molecules of one or more selected constituents of mainstream tobacco smoke that are desired to be removed by the sorbent. Only those constituents of the mainstream tobacco smoke that are small enough to enter into the pores of the carbon fiber composite molecular sieve sorbent can be adsorbed on the interior surface of the pores. Thus, constituents of mainstream tobacco smoke having small molecular structures are selectively sorbed by the carbon fiber composite molecular sieve, while larger constituents, such as those contributing to flavor, remain in the smoke.

The pore size of the carbon fiber composite molecular sieve sorbent can be adjusted in the manufacturing process by controlling the percentage burn-off during activation of the carbon fibers. In a preferred embodiment, the carbon fiber composite molecular sieve sorbent may be manufactured to selectively remove one or more constituents including, but not limited to, acetaldehyde, carbonyl sulfide, hydrogen cyanide, isoprene, methanol and propylene. Such selective removal of mainstream tobacco smoke constituents can be achieved by a carbon fiber composite molecular sieve sorbent that contains pores larger in size than those constituents that are desired to be removed from mainstream tobacco smoke. In a preferred embodiment, the average pore size of the carbon fiber composite molecular sieve sorbent is less than about 2 nm, and more preferably less than about 1.5 nm.

In a preferred embodiment, the carbon fiber composite molecular sieve sorbent is incorporated in the filter portion of a smoking article. In the filter portion, the carbon fiber composite molecular sieve sorbent can be incorporated in various ways, including, for example, with various materials, such as paper, fibers and other materials, and/or the sorbent can be incorporated in a space and/or void. For example, paper can be inserted into a hollow portion of the cigarette filter. The paper is preferably in the form of a sheet material, such as crepe paper, filter paper or tipping paper. However, other suitable materials, such as organic or inorganic cigarette compatible materials, can also be used. The carbon fiber composite molecular sieve sorbent can be incorporated in one or more locations in the filter portion.

The carbon fiber composite molecular sieve sorbent can be incorporated in tobacco bed in the smoking article. For example, in a cigarette or cigar, the carbon fiber composite molecular sieve sorbent can be located in the tobacco rod.

The amount of the carbon fiber composite molecular sieve sorbent provided in the smoking article can be varied. For example, about 10 mg to about 300 mg of the composite molecular sieve sorbent is typically used in a cigarette. For example, amounts such as about 20, 30, 50, 75, 100, 150, 200, or 250 mg of the carbon fiber composite molecular sieve sorbent can be used in a cigarette.

The carbon fiber composite molecular sieve sorbent can be used in various filter constructions. Exemplary filter constructions include, but are not limited to, a mono filter, a dual filter, a triple filter, a single- or multiple cavity filter, a recessed filter, or a free-flow filter. Mono filters typically contain cellulose acetate tow or cellulose paper. Dual filters typically comprise a cellulose acetate mouthpiece plug and a second, usually different, filter plug or segment. The length and pressure drop of the two segments of the dual filter can be adjusted to provide optimal adsorption, while maintaining acceptable draw resistance. Triple filters can include mouth and smoking material or tobacco side segments, while the middle segment comprises a material or paper containing the carbon fiber composite molecular sieve sorbent. Cavity filters typically include two segments, e.g., acetate-acetate, acetate-paper or paper-paper, separated by a cavity containing the carbon fiber composite molecular sieve sorbent. Recessed filters include an open cavity on the mouth side and typically incorporate the carbon fiber composite molecular sieve sorbent into the plug material. The filters may also optionally be ventilated, and/or comprise additional sorbents (such as charcoal or magnesium silicate), catalysts, flavorants, and/or other additives.

FIGS. 7-14 illustrate cigarettes 2 including different filter constructions in which the carbon fiber composite molecular sieve sorbent can be incorporated. In each of these embodiments, the carbon fiber composite molecular sieve sorbent can be incorporated in the cigarette in the filter portion 6, and/or optionally in the tobacco rod 4. In each of these embodiments, a desired amount of the carbon fiber composite molecular sieve sorbent can be provided in the cigarette filter portion and/or tobacco rod by varying the size and/or density of the carbon fiber composite molecular sieve sorbent, or by incorporating more than one carbon fiber composite molecular sieve sorbent in the cigarette filter and/or the tobacco rod.

Figure 7:
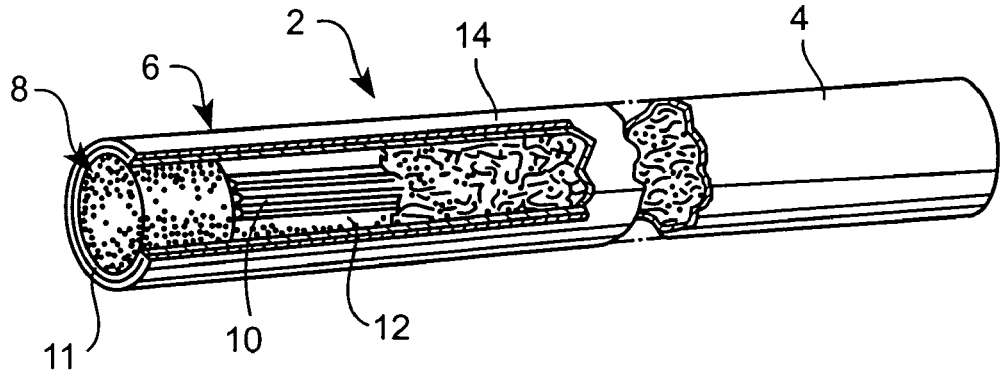
FIG. 7 illustrates a cigarette including an embodiment of a filter portion having a tubular filter element.

FIG. 7 illustrates a cigarette 2 including a tobacco rod 4, a filter portion 6 and a mouthpiece filter plug 8. The carbon fiber composite molecular sieve sorbent can replace the folded paper 10, which is disposed in the hollow interior of a free-flow sleeve 12 forming part of the filter portion 6.

Figure 8:
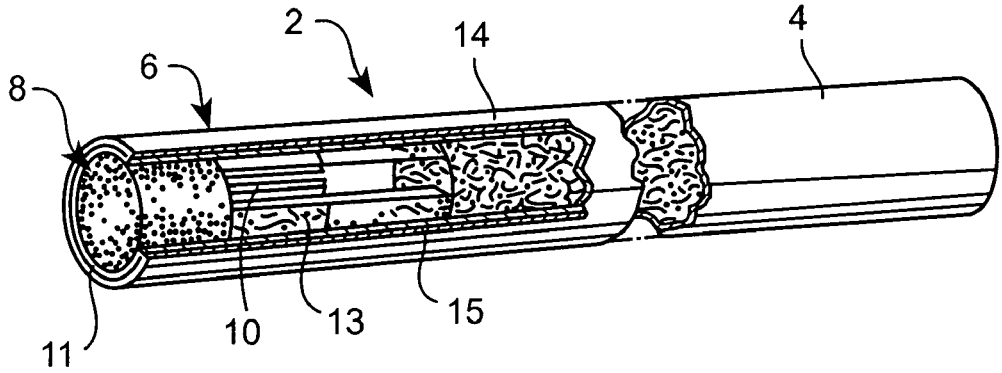
FIG. 8 illustrates a cigarette including another embodiment of the filter portion having a first free-flow sleeve next to a second free-flow sleeve.

FIG. 8 depicts a cigarette 2 including a tobacco rod 4 and a filter portion 6. Folded paper 10 is disposed in the hollow cavity of a first free-flow sleeve 13 located between the mouthpiece filter 8 and a second free-flow sleeve 15. The paper 10 can be in forms other than a folded sheet, such as one or more individual strips, a wound roll, or the like. In the cigarettes shown in FIGS. 7 and 8, the tobacco rod 4 and the filter portion 6 are joined together with tipping paper 14. In both cigarettes, the filter portion 6 may be held together by filter overwrap 11. In this embodiment, the carbon fiber composite molecular sieve sorbent monolith can be incorporated into the filter portion of the cigarette, for example, in place of the paper 10 of the first free-flow sleeve 13 and/or in the interior of the second free-flow sleeve 15.

Figure 9:
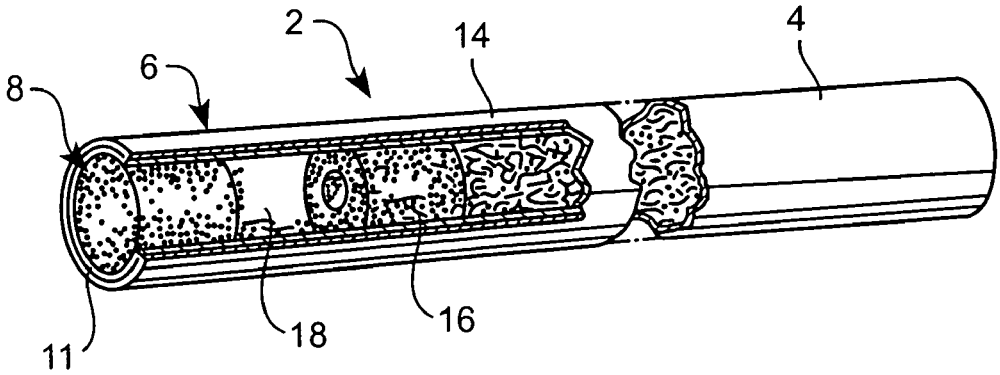
FIG. 9 illustrates a cigarette including a further embodiment of the filter portion having a plug-space-plug filter element.

In another preferred embodiment, the carbon fiber composite molecular sieve sorbent is incorporated with the fibrous material of the cigarette filter portion itself. Such fibrous filter materials include, but are not limited to, paper, cellulose acetate fibers and polypropylene fibers. Such embodiment is depicted in FIG. 9, which shows a cigarette 2 including a tobacco rod 4 and a filter portion 6 in the form of a plug-space-plug filter including a mouthpiece filter 8, a plug 16 and a space 18. The plug 16 can comprise a tube or solid piece of material, such as polypropylene or cellulose acetate fibers. The tobacco rod 4 and the filter portion 6 are joined together with tipping paper 14. The filter portion 6 can include a filter overwrap 11. The carbon fiber composite molecular sieve sorbent monolith can be incorporated, for example, in the plug 16 and/or the space 18.

Figure 10:
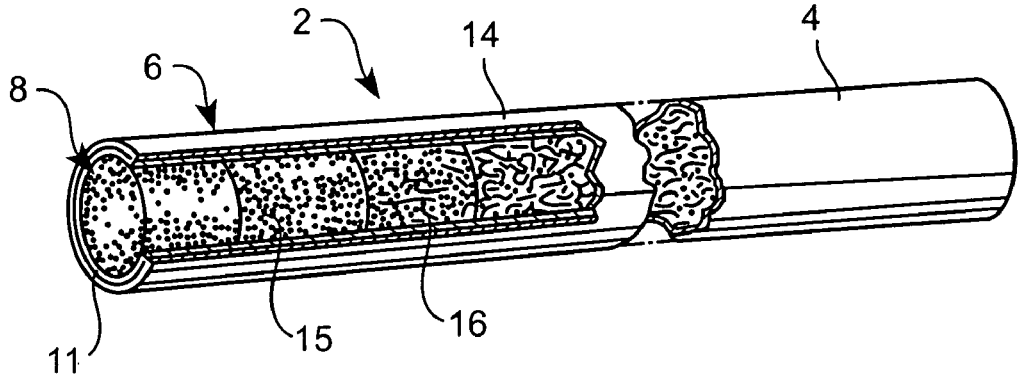
FIG. 10 illustrates a cigarette including yet another embodiment of the filter portion having a three-piece filter element.

FIG. 10 shows a cigarette 2 including a tobacco rod 4 and filter portion 6. This embodiment is similar to the cigarette of FIG. 9 except the space 18 contains a carbon fiber composite molecular sieve sorbent. As in the previous embodiment, the plug 16 can be hollow or solid. The tobacco rod 4 and filter portion 6 are joined together with tipping paper 14. The cigarette also includes a filter overwrap 11. In this embodiment, the carbon fiber composite molecular sieve sorbent can be incorporated in the plug 16.

Figure 11:
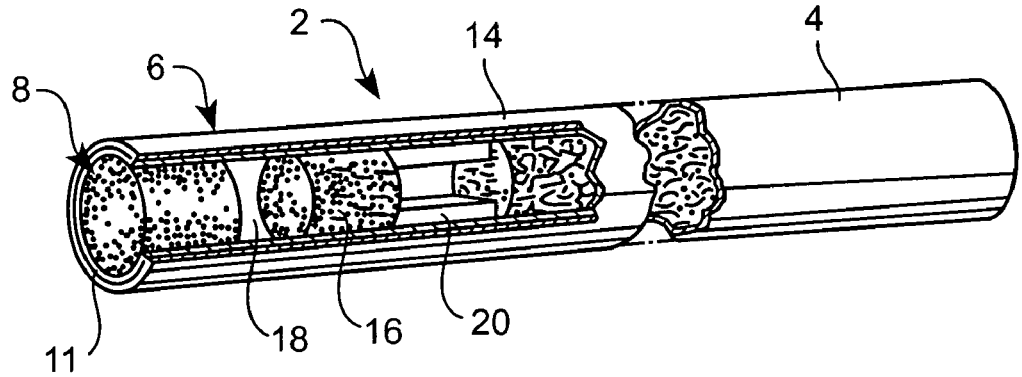
FIG. 11 illustrates a cigarette including another embodiment of the filter portion having a four-piece filter element.

FIG. 11 shows a cigarette 2 including a tobacco rod 4 and a filter portion 6. The filter portion 6 includes a mouthpiece filter 8, a filter overwrap 11, tipping paper 14 joining the tobacco rod 4 and filter portion 6, a space 18, a plug 16 and a hollow sleeve 20. The carbon fiber composite molecular sieve sorbent monolith can be incorporated into one or more elements of the filter portion 6, such as, for example, in the space 18, plug 16 and/or the hollow sleeve 20.

Figure 12:
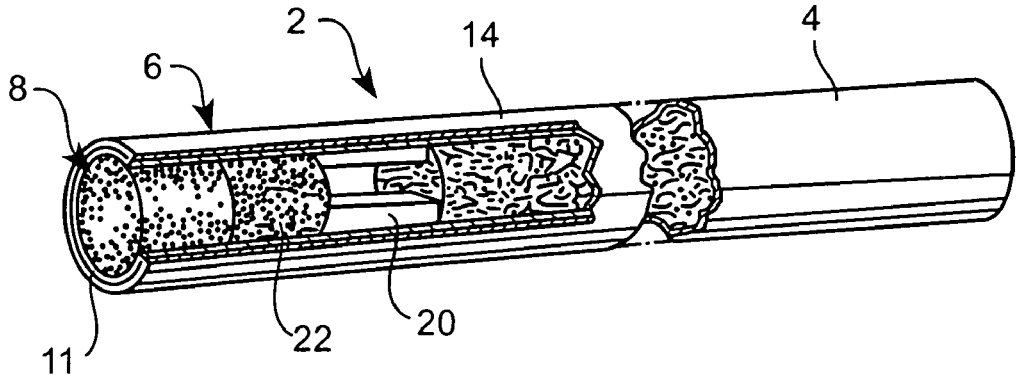
FIG. 12 illustrates a cigarette including a further embodiment of the filter portion having a three-piece filter element.
Figure 13:
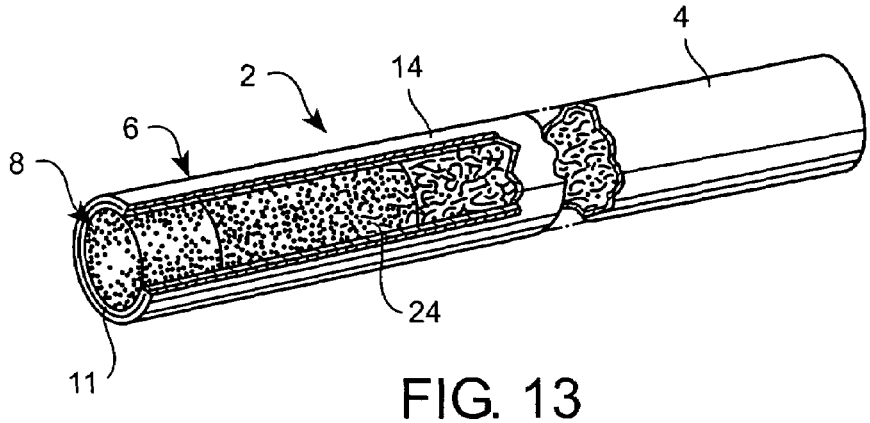
FIG. 13 illustrates a cigarette including yet another embodiment of the filter portion having a two-part filter element.

FIGS. 12 and 13 show further embodiments of the filter portion 6. In the embodiment depicted in FIG. 12, the cigarette 2 includes a tobacco rod 4 and a filter portion 6. The filter portion 6 includes a mouthpiece filter 8, a filter overwrap 11, a plug 22 and a hollow sleeve 20. The tobacco rod 4 and filter portion 6 are joined together by tipping paper 14. In this embodiment, the carbon fiber composite molecular sieve sorbent monolith can be incorporated in one or more of these filter elements, such as, for example, in the plug 22 and/or the sleeve 20.

In the embodiment shown in FIG. 13, the filter portion 6 includes a mouthpiece filter 8 and a plug 24. The tobacco rod 4 and filter portion 6 are joined together by tipping paper 14. The carbon fiber composite molecular sieve sorbent monolith can be incorporated in the plug 24.

As described above, in some preferred embodiments, the carbon fiber composite molecular sieve sorbent is located in a hollow portion of the cigarette filter. For example, as shown in FIG. 9, the carbon fiber composite molecular sieve sorbent monolith can be placed in the space of a plug/space/plug filter configuration. As shown in FIGS. 8, 11 and 12, the carbon fiber composite molecular sieve sorbent also can be placed in the interior of a hollow sleeve.

Figure 14:
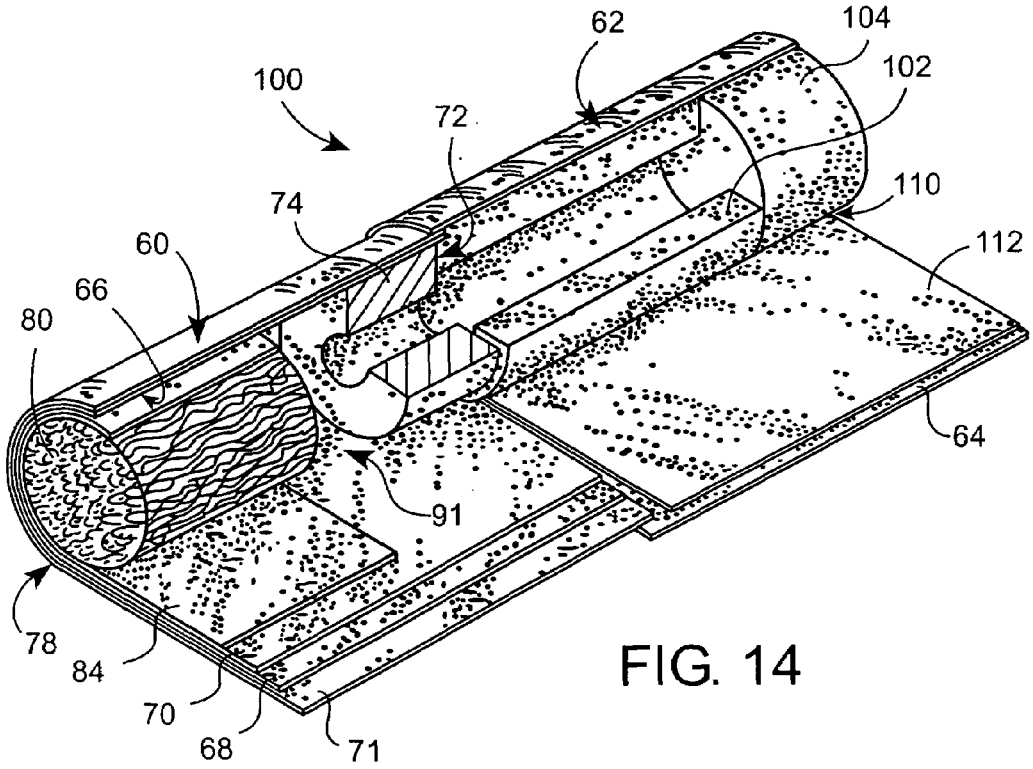
FIG. 14 illustrates a cigarette for an electrical smoking system.

In another embodiment, the carbon fiber composite molecular sieve sorbent is provided in the filter portion of a cigarette for use with an electrical smoking device as described, for example, in U.S. Pat. No. 5,692,525, which is incorporated herein by reference in its entirety. FIG. 14 illustrates an embodiment of a cigarette 100, which can be used with an electrical smoking device. As shown, the cigarette 100 includes a tobacco rod 60 and a filter portion 62 joined by tipping paper 64. The filter portion 62 contains a tubular free-flow filter element 102 and a mouthpiece filter plug 104. The free-flow filter element 102 and mouthpiece filter plug 104 can be joined together as a combined plug 110 with a plug wrap 112. The tobacco rod 60 can have various forms incorporating one or more of an overwrap 71, another tubular free-flow filter element 74, a cylindrical tobacco plug 80 preferably wrapped in a plug wrap 84, a tobacco web 66 comprising a base web 68 and tobacco flavor material 70, and a void 91. The free-flow filter element 74 provides structural definition and support at the tipped end 72 of the tobacco rod 60. At the free end 78 of the tobacco rod 60, the tobacco web 66 and overwrap 71 are wrapped about a cylindrical tobacco plug 80. Various modifications can be made to the filter arrangement for such a cigarette incorporating the carbon fiber composite molecular sieve sorbent.

The carbon fiber composite molecular sieve sorbent can be incorporated at one or more locations of the filter portion 62 of such non-traditional cigarette 100. For example, the carbon fiber composite molecular sieve sorbent monolith can placed in the passageway of the tubular free-flow filter element 102, the free-flow filter element 74 and/or the void space 91. Further, the filter portion 62 can be modified to create a void space into which carbon fiber composite molecular sieve sorbent can be located.

The amount of carbon fiber composite molecular sieve sorbent used in the cigarette filter and/or tobacco rod of a cigarette can be selected based on the amount of constituents in the tobacco smoke, and the amount of the constituent(s) that is/are desired to be removed from the tobacco smoke. As an example, the filter may contain from 10% to 50% by weight of carbon fiber composite molecular sieve sorbent.

An exemplary embodiment of a method of making a filter comprises incorporating a carbon fiber composite molecular sieve sorbent into a cigarette filter and/or a tobacco rod, where the carbon fiber composite molecular sieve sorbent is capable of selectively removing one or more selected constituents from mainstream tobacco smoke. Any conventional or modified method of making cigarette filters may be used to incorporate the carbon fiber composite molecular sieve sorbent in the cigarette.

Exemplary embodiments of methods for making cigarettes comprise placing a paper wrapper around a tobacco column to form a tobacco rod, and attaching a cigarette filter to the tobacco rod to form the cigarette. The cigarette filter and/or tobacco rod contains the carbon fiber composite molecular sieve.

Examples of suitable types of tobacco materials that may be used include flue-cured, Burley, Maryland or Oriental tobaccos, rare or specialty tobaccos and blends thereof. The tobacco material can be in the form of tobacco lamina; processed tobacco materials, such as volume expanded or puffed tobacco, processed tobacco stems, such as cut-rolled or cut-puffed stems, reconstituted tobacco materials, or blends thereof. Tobacco substitutes may also be used.

In cigarette manufacture, the tobacco is normally in the form of cut filler, i.e., in the form of shreds or strands cut into widths ranging from about 1/10 inch to about 1/20 inch, or even 1/40 inch. The lengths of the strands range from between about 0.25 inches to about 3.0 inches. The cigarettes may further comprise one or more flavorants or other additives (e.g., burn additives, combustion modifying agents, coloring agents, binders and the like). The flavorant is preferably provided in the filter.

Any suitable technique for cigarette manufacture may be used to incorporate the carbon fiber composite molecular sieve sorbent. The resulting cigarettes can be manufactured to any desired specification using standard or modified cigarette making techniques and equipment. The cigarettes may range from about 50 mm to about 120 mm in length. The circumference is from about 15 mm to about 30 mm, and preferably around 25 mm. The packing density is typically between the range of about 100 mg/cm$^3$ to about 300 mg/cm$^3$, and preferably about 150 mg/cm$^3$ to about 275 mg/cm$^3$.

Other preferred embodiments relate to methods of treating mainstream tobacco smoke, which involve heating or lighting a cigarette to form smoke and drawing the smoke through the cigarette. During the smoking of the cigarette, the carbon fiber composite molecular sieve sorbent selectively removes one or more selected constituents from mainstream smoke.

"Smoking" of a cigarette means the heating or combustion of the cigarette to form tobacco smoke. Generally, smoking of a cigarette involves lighting one end of the cigarette and drawing the cigarette smoke through the mouth end of the cigarette, while the tobacco contained in the tobacco rod undergoes a combustion reaction. However, the cigarette may also be smoked by heating the cigarette using an electrical heater, as described, for example, in any one of commonly-assigned U.S. Pat. Nos. 6,053,176; 5,934,289; 5,591,368 and 5,322,075, each of which is incorporated herein by reference in its entirety.

EXAMPLE 1

A sample carbon fiber composite molecular sieve sorbent was produced using isotropic pitch fibers and phenolic resin by slurry molding. The carbonized composite was activated in $CO_2$ at a temperature of about 860° C. to a burn-off of about 30%. The carbon fiber composite molecular sieve sorbent had a post-activation density of about 0.2 g/cm$^3$.

Figure 15:
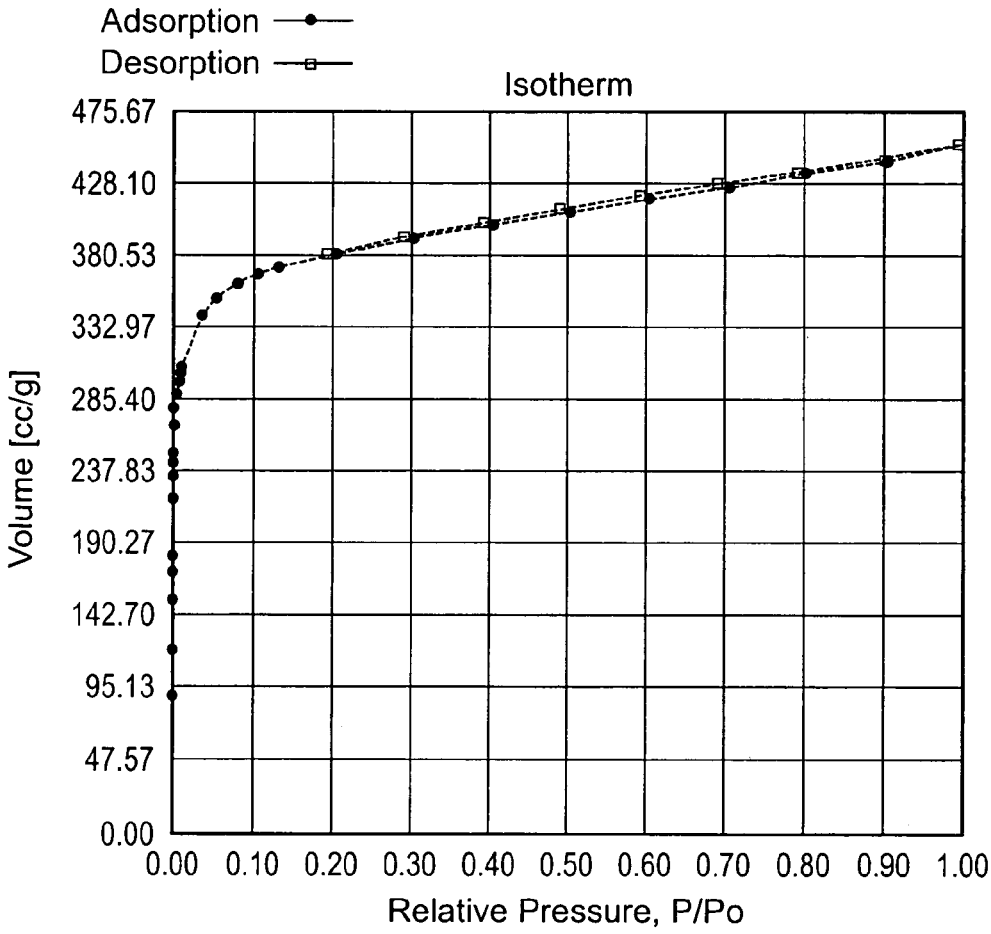
FIG. 15 illustrates an adsorption isotherm for an embodiment of the carbon fiber composite molecular sieve sorbent.
Figure 16:
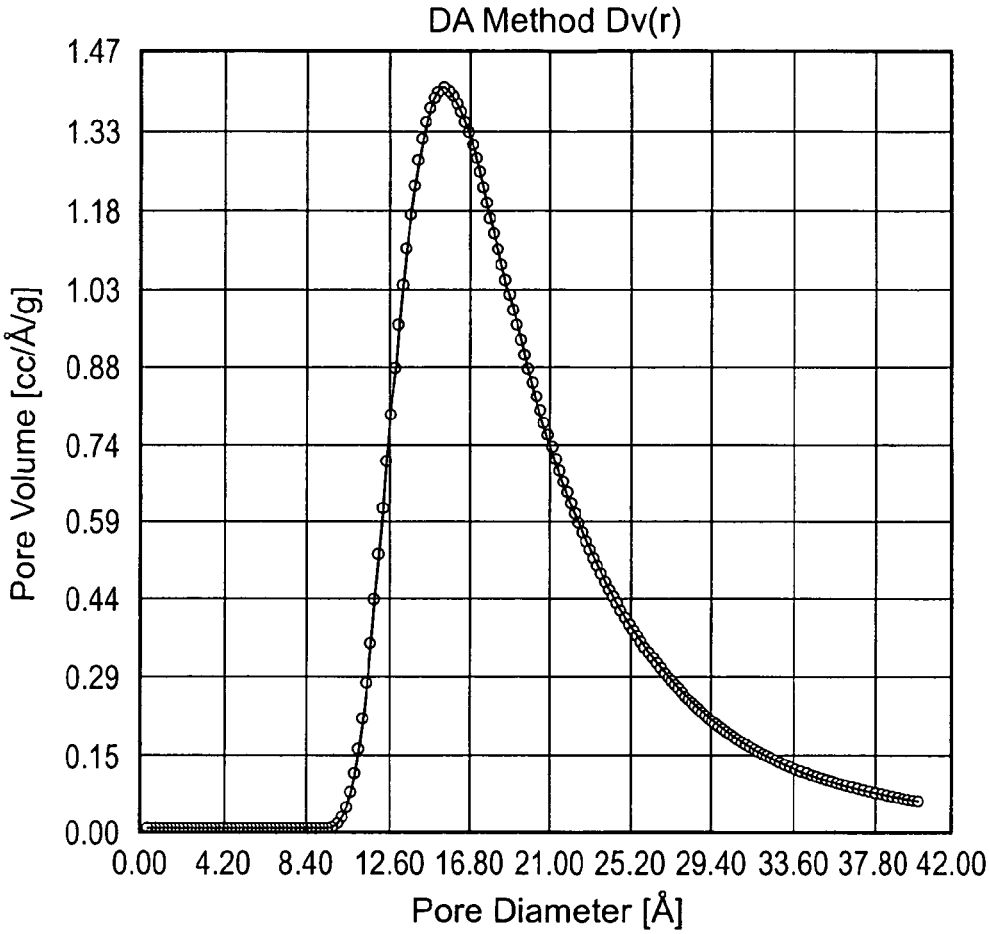
FIG. 16 illustrates the micropore size distribution for an embodiment of the carbon fiber composite molecular sieve sorbent.

FIG. 15 shows the $N_2$ adsorption isotherm at 77K of the carbon fiber composite molecular sieve sorbent. FIG. 16 shows the micropore size distribution of the carbon fiber composite molecular sieve sorbent using the Dubinin-Astakhov (D-A) method. The carbon fiber composite molecular sieve sorbent had a BET surface area of 1470 m$^2$/g, a micropore volume of 0.55 cm$^3$/g, a D-R pore width of 2.1 nm and a D-A pore width of 1.5 nm.

EXAMPLE 2

Samples 1-5 according to a preferred embodiment were prepared by modifying five Industry Monitor (IM-16) cigarettes having a plug-space-space filter construction. For each of the samples, a carbon fiber composite molecular sieve sorbent in rod form and having a diameter of 7.8 mm, a length of 12 mm and a mass of 125 mg was placed between cellulose acetate plugs in the filter of the IM-16 cigarette. The filter had a total length of about 21 mm. In addition, control samples 6-10 were prepared by modifying five IM-16 cigarettes by cutting the cellulose plug into three pieces and reinserting the plug into the filter portion.

Samples 1-5 and control samples 6-10 were lit with an electric lighter and smoked under FTC conditions (2 second, 35 cm$^3$ puff every 60 seconds; 72° F.; 60% relative humidity). The fourth puff of each cigarette was analyzed using the Fourier Transform Infrared (FTIR) technique with a Bio-Rad FTS-60 FTIR spectrometer. For samples 1-5 and control samples 6-10, the delivered amounts of the gas phase smoke constituents acetaldehyde, hydrogen cyanide, propylene, methanol and isoprene were determined. The values for samples 1-5 and control samples 6-10, respectively, were averaged for these five compounds. The values were normalized to total particulate matter (TPM) in the smoke stream. The percent difference between the average amount of the five compounds delivered by samples 1-5 and the average amount of the five compounds delivered by control samples 6-10 was determined to be as follows: acetaldehyde, −71%; hydrogen cyanide, −50%; isoprene, −81%; methanol, −62%; and propylene, −48%. Accordingly, the samples containing the carbon fiber composite molecular sieve sorbent were significantly more efficient in removing acetaldehyde, hydrogen cyanide, isoprene, methanol and propylene than the control cigarettes including only a cellulose acetate filter element.

In addition, the average resistance to draw (RTD) of samples 1-5 was measured and compared to the average RTD of control samples 6-10. The average RTD of samples 1-5 was 141 mm $H_2O$, which is within an acceptable range. The average RTD of control samples 6-10 was 167 mm $H_2O$. The test results demonstrate that cigarettes containing a carbon fiber composite molecular sieve sorbent can also provide a lower RTD than cigarettes containing a conventional cellulose acetate filter element.

The test results demonstrate that the carbon fiber composite molecular sieve sorbent can selectively remove selected constituents from mainstream smoke. In addition, the sorbent can provide a desirably high gas permeability.

While the invention has been described in detail with reference to preferred embodiments thereof, it will be apparent to one skilled in the art that various changes can be made, and equivalents employed, without departing from the scope of the invention.

What is claimed is:

1. A cigarette filter comprising at least one porous body of interbonded activated carbon fibers disposed in a filter portion, wherein the porous body has a density of from about 0.15 $g/cm^3$ to about 0.25 $g/cm^3$.

2. The cigarette filter of claim 1, wherein the porous body consists essentially of the activated carbon fibers and carbon joints which interbond the activated carbon fibers.

3. The cigarette filter of claim 1, wherein the carbon fibers have a length of from about 100 microns to about 1000 microns, and a diameter of from about 10 microns to about 25 microns.

4. The cigarette filter of claim 1, wherein the activated carbon fibers are randomly oriented in the porous body.

5. The cigarette filter of claim 1, wherein the porous body has a BET surface area of from about 1000 $m^2/g$ to about 2,500 $m^2/g$, and a D-R micropore volume of from about 0.1 $cm^3/g$ to about 1 $cm^3/g$.

6. The cigarette filter of claim 1, wherein the porous body has an average pore size of less than about 2 nm.

7. The cigarette filter of claim 1, wherein the porous body is electrically conductive.

8. The cigarette filter of claim 1, wherein the porous body includes an outer surface and a protective coating of carbon on the outer surface.

9. A cigarette filter comprising at least one porous body of interbonded activated carbon fibers disposed in a filter portion, wherein the porous body is capable of reducing acetaldehyde, hydrogen cyanide, isoprene, methanol and propylene from mainstream tobacco smoke relative to total particulate matter in the smoke when the porous body is contained in a cigarette.

10. The cigarette filter of claim 1, wherein the porous body is cylindrical, has an outer diameter approximately equal to a diameter of the cigarette filter, and has a length of from about 10 mm to about 20 mm.

11. The cigarette filter of claim 1, which is a mono filter, a dual filter, a triple filter, a cavity filter, a recessed filter, or a free-flow filter.

12. The cigarette filter of claim 1, which further comprises at least one of cellulose acetate tow, cellulose paper, mono cellulose and mono acetate.

13. The cigarette filter of claim 1, wherein the porous body is incorporated in a space and/or a void of the cigarette filter.

14. The cigarette filter of claim 1, wherein the porous body of interbonded activated carbon fibers is a carbonized monolithic porous body.

15. The cigarette filter of claim 14, wherein the carbon fibers have a length of from about 100 microns to about 1000 microns, and a diameter of from about 10 microns to about 25 microns.

16. The cigarette filter of claim 14, wherein the porous body has a BET surface area of from about 1000 $m^2/g$ to about 2,500 $m^2/g$, and a D-R micropore volume of from about 0.1 $cm^3/g$ to about 1 $cm^3/g$.

17. The cigarette filter of claim 14, wherein the porous body has an average pore size of less than about 2 nm.

18. The cigarette filter of claim 14, wherein the porous body has an outer surface and a protective coating of carbon on the outer surface.

19. The cigarette filter of claim 14, wherein the porous body is electrically conductive.

20. The cigarette filter of claim 14, wherein the porous body is capable of selectively removing at least one of acetaldehyde, hydrogen cyanide, isoprene, methanol and propylene from mainstream tobacco smoke when contained in a cigarette.

21. A cigarette comprising a cigarette filter according to claim 1 and a tobacco rod, wherein the filter is attached to and separate from the tobacco rod and is entirely downstream of the tobacco rod.

22. The cigarette of claim 21, which is a non-traditional cigarette.

23. A cigarette comprising a cigarette filter according to claim 1.

24. The cigarette of claim 23, which is a non-traditional cigarette.

25. A method of manufacturing a cigarette, comprising:

placing a paper wrapper around a tobacco column to form a tobacco rod; and attaching the cigarette filter of claim 1 to the tobacco rod to form the cigarette.

26. A method of manufacturing a cigarette, comprising:

placing a paper wrapper around a tobacco column to form a tobacco rod; and attaching the cigarette filter of claim 14 to the tobacco rod to form the cigarette.

27. A method of treating mainstream tobacco smoke during smoking the cigarette of claim 21, comprising heating or lighting the cigarette to form smoke, and drawing the smoke through the cigarette, the porous body selectively removing at least one selected constituent from mainstream smoke.

28. The method of claim 27, wherein the porous body selectively removes at least one of acetaldehyde, hydrogen cyanide, propylene, methanol and isoprene from the mainstream smoke.

29. A method of treating mainstream tobacco smoke during smoking the cigarette of claim 23, comprising heating or lighting the cigarette to form smoke, and drawing the smoke through the cigarette, the porous body selectively removing at least one selected constituent from mainstream smoke.

30. The method of claim 29, wherein the porous body selectively removes at least one of acetaldehyde, hydrogen cyanide, isoprene, methanol and propylene from the mainstream smoke.

* * * * *